US005707043A

United States Patent [19]

Yoshida

[11] Patent Number: 5,707,043

[45] Date of Patent: Jan. 13, 1998

[54] ELECTRIC POWER TOOL FOR DRIVING JACK

[75] Inventor: Kazuhiko Yoshida, Saitama, Japan

[73] Assignee: Rikenkaki Kogyo Kabushiki Kaisha, Sakad, Japan

[21] Appl. No.: 566,873

[22] Filed: Dec. 4, 1995

[30] Foreign Application Priority Data

Sep. 5, 1995 [JP] Japan ..... 7-227813

[51] Int. Cl.[6] ..... B66F 3/08

[52] U.S. Cl. ..... 254/126

[58] Field of Search ..... 81/124.2, 121.1, 81/176.1, 176.15, 176.2; 254/DIG. 3, DIG. 2, 103–122, 126

[56] References Cited

U.S. PATENT DOCUMENTS

| | | | |
|---|---|---|---|
| 1,078,567 | 11/1913 | Wagenhorst | 81/124.2 |
| 4,653,727 | 3/1987 | Chang et al. | 254/126 |
| 4,749,169 | 6/1988 | Pickles | 854/122 |
| 4,943,034 | 7/1990 | Wagnon | 254/122 |
| 4,979,355 | 12/1990 | Ulevich | 81/121.1 |
| 4,984,489 | 1/1991 | Krauthamer | 81/124.2 |
| 5,085,406 | 2/1992 | Schmaltz | 254/DIG. 3 |
| 5,085,407 | 2/1992 | Lonon | 254/DIG. 3 |
| 5,101,695 | 4/1992 | Johnson | 81/121.1 |
| 5,165,660 | 11/1992 | Engel et al. | 254/DIG. 3 |
| 5,496,014 | 3/1996 | Hsu | 254/103 |

FOREIGN PATENT DOCUMENTS 5-40071 10/1993 Japan .

*Primary Examiner*—Robert C. Watson

*Attorney, Agent, or Firm*—Nikaido, Marmelstein, Murray & Oram LLP

[57] ABSTRACT

A driving joint includes a joint block secured to an output shaft of an electric driving unit, and a U-shaped connection plate connected at its opposite ends to the joint block and provided at its front wall with an elongated connection hole. The connection plate can be engaged within the U-shaped driven joint, and the elongated connection hole can be fitted to a connection plate of a T-shaped driven joint. With this arrangement, various types of jacks having different types of driven joints can be driven by a single electric tool.

2 Claims, 10 Drawing Sheets

ELECTRIC POWER TOOL FOR DRIVING JACK

BACKGROUND OF THE INVENTION

1. Field of the Invention

The present invention relates to an electric power tool for driving a jack for lifting and lowering by electric power the jack which is usually provided in an automobile, and more particularly, to an improvement of an electric power tool for driving a jack, including: an electric driving unit including a normally and reversely rotatable motor, a driving joint provided on an output shaft of the electric driving unit and capable of being connected and engaged with a driven joint of the jack.

2. Description of the Prior Art

Such an electric power tool for driving a jack is already known as disclosed in Japanese Utility Model Publication No.40071/93.

As a driven joint of a jack for an automobile, two types of driven joints are mainly used, i.e., a U-shaped driven joint as shown by a reference numeral 8 in FIGS. 5 and 6, and a T-shaped driven joint as shown by a reference numeral 8' in FIGS. 10 and 11. Meanwhile, a driving joint of the known electric power tool is designed to be engaged with only one of the U-shaped and T-shaped driven joints and thus, it can be used for only one of them, lacking the wide utility. Therefore, it is difficult to mass-produce the electric power tool and to reduce a manufacturing cost.

SUMMARY OF THE INVENTION

The present invention has been accomplished in view of the above circumstances, and it is an object of the present to provide an electric power tool for driving a jack having a driving joint which can be connected and engaged with any of the above-mentioned two types of driven joint.

To achieve the above object, according to a first feature, there is provided an electric power tool for driving a jack, comprising: an electric driving unit including a normally and reversely rotatable motor, and a driving joint provided on an output shaft of the electric driving unit and capable of being connected and engaged with a driven joint of a jack, wherein the driving joint comprises a joint block secured to the output shaft, and a joint plate which is coupled at opposite ends thereof to the joint block and is projected forwardly of the joint block and which is formed at its projected portion with an elongated connection hole, the joint plate and the elongated connection hole being formed such that when the driven joint of the jack is U-shaped, the joint plate can be connected and engaged within such U-shaped driven joint, whereas when the driven joint of the jack is T-shaped, the elongated connection hole can be connected and engaged with a connection plate of such T-shaped driven joint.

With the above arrangement, both the driving and driven joints can be connected and engaged with each other, by inserting the joint plate of the driving joint into the driven joint if the driven joint of the jack is of T-shaped type, and by fitting the connection plate to the elongated connection hole of the driving joint if the driven joint is of U-shaped type. Therefore, a single driving joint can be used for two types of driven joint, thereby making it possible to mass-produce the electric power tool, and to reduce the manufacturing cost.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of a preferred embodiment taken in conjunction with the accompanying drawings.

Figure 1:
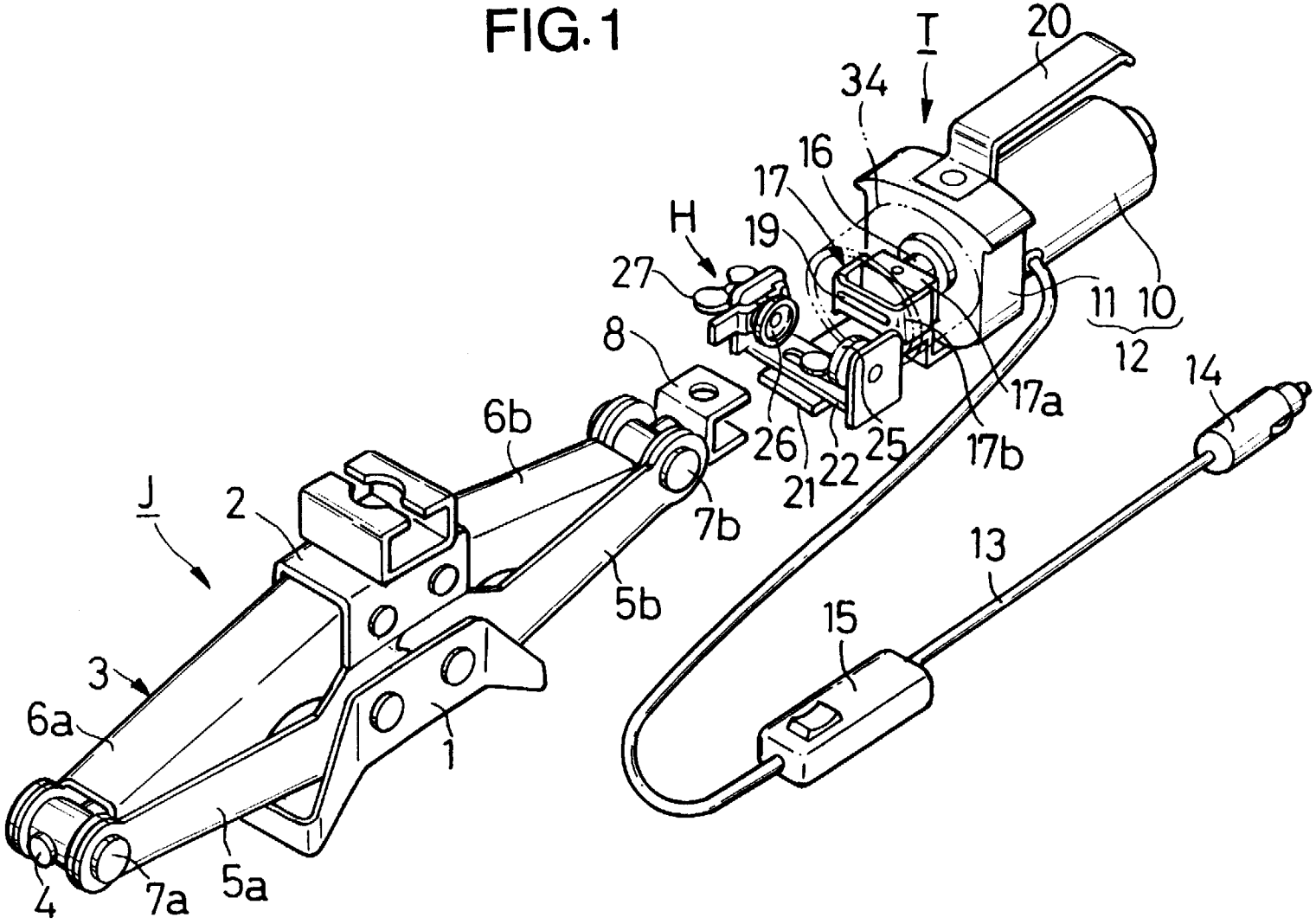
FIG. 1 is a perspective view of an electric power tool for driving a jack according to the present invention.
Figure 2:
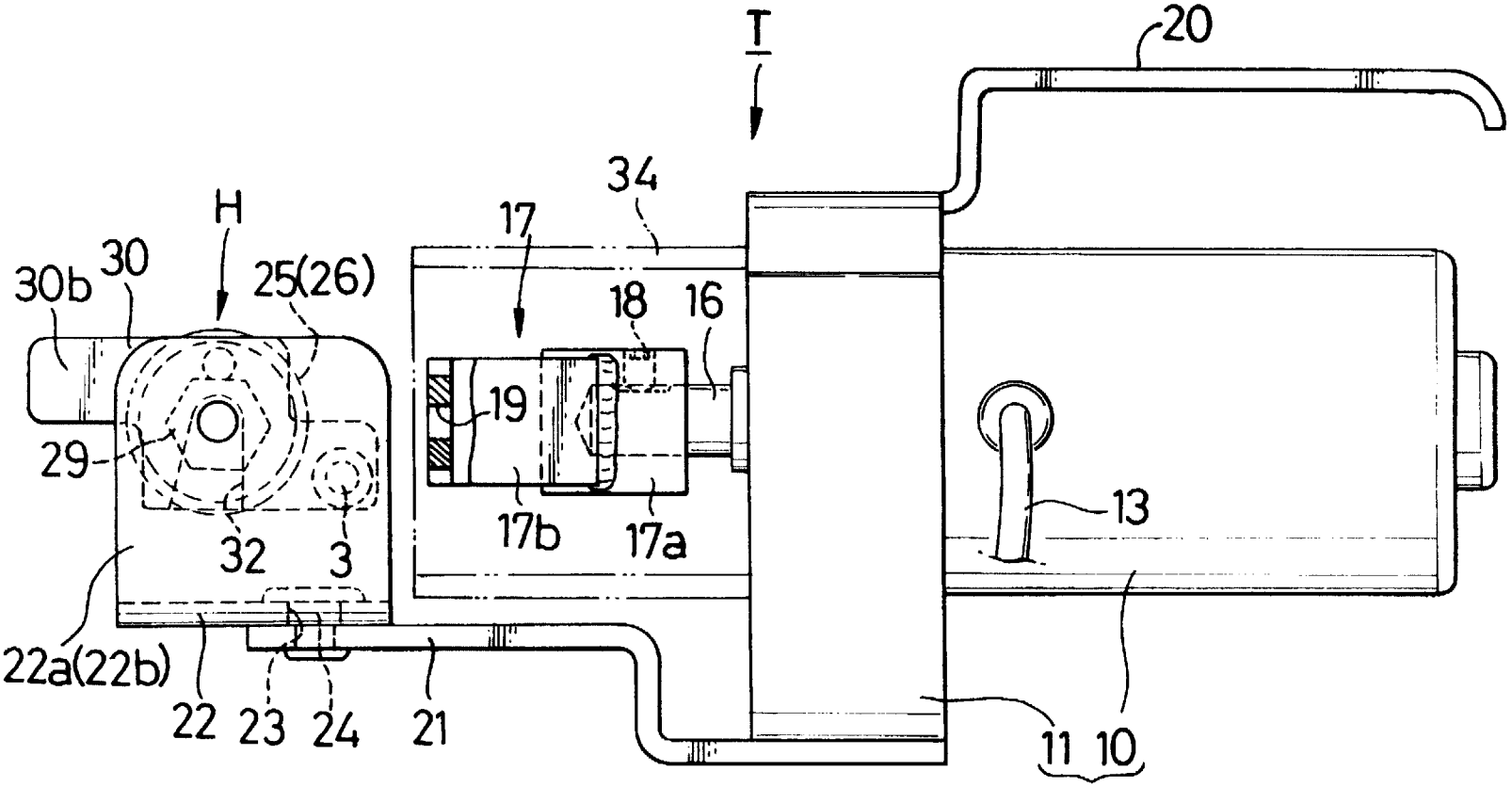
FIG. 2 is a side view of the electric power tool.
Figure 3:
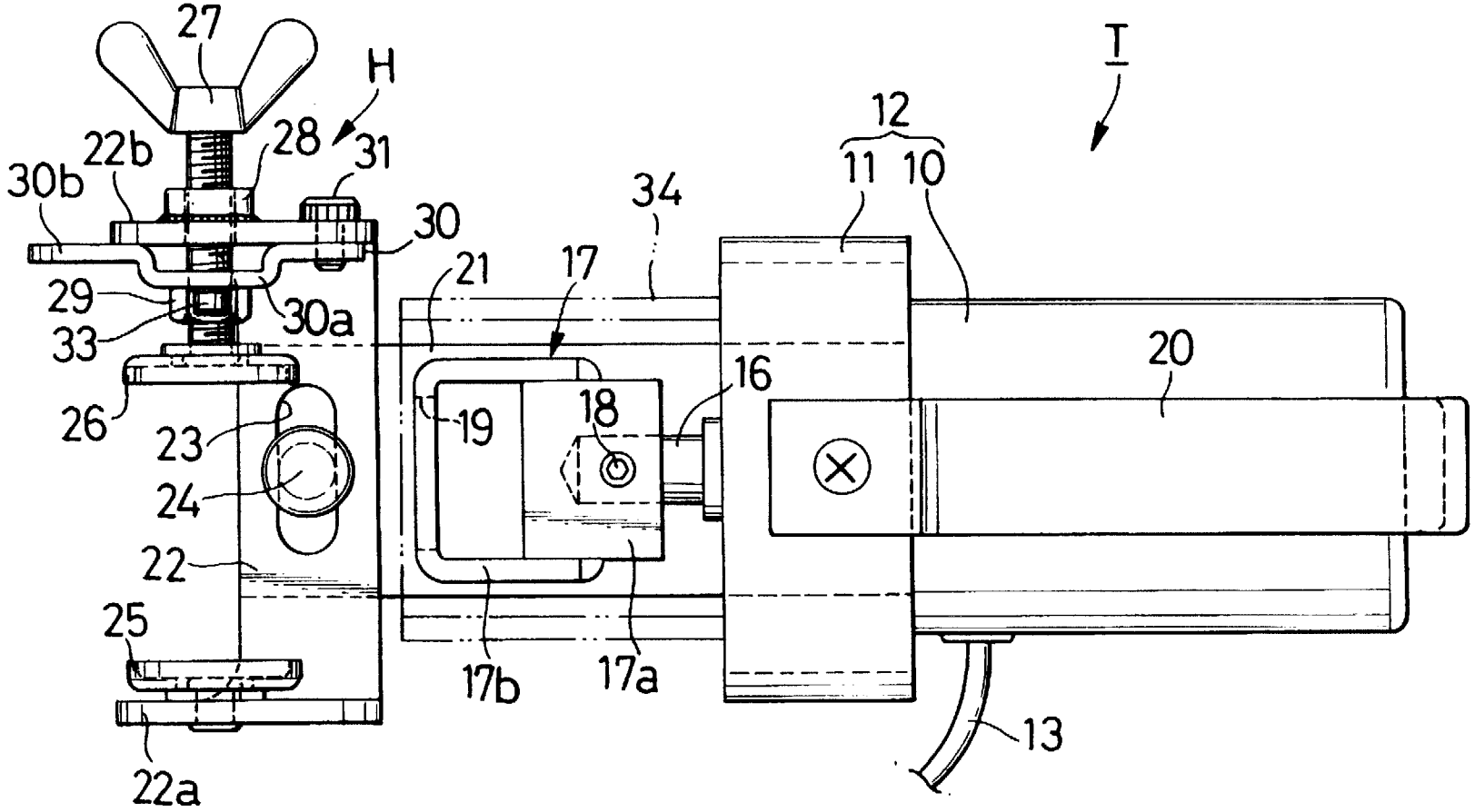
FIG. 3 is a plan view of the electric power tool.
Figure 4:
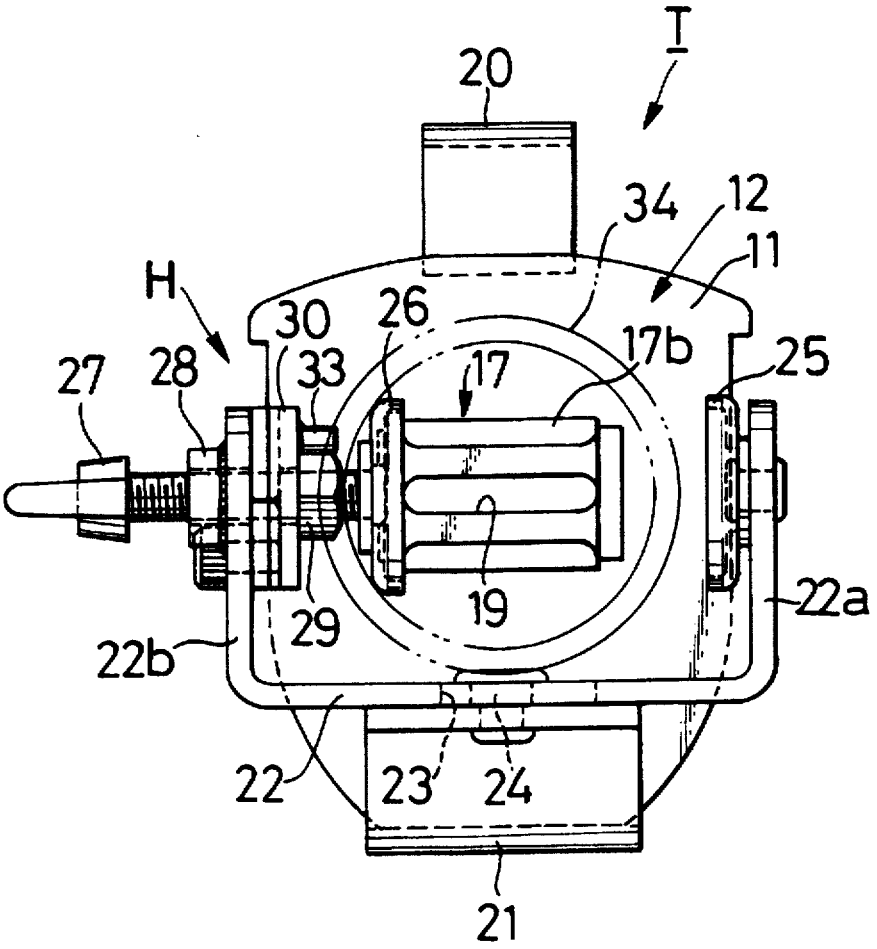
FIG. 4 is a front view of the electric power tool.

Referring to FIG. 1, a reference number "J" represents a jack for an automobile, and a reference number "T" represents an electric power tool for the jack.

Although the illustrated jack J is of a pantagraph type, any type of jack may be used. The jack J includes a pedestal 1, a load receiving block 2, a link mechanism 3 interposed therebetween for liftably connecting the load receiving block 2 to the pedestal 1, and a threaded rod 4 for lifting and lowering the load receiving block 2 through the link mechanism 3.

The link mechanism 3 includes a pair of front and rear glower arms *5a* and *5b* whose inner ends are pivotally connected to the pedestal 1, a pair of front and rear upper arms *6a* and *6b* whose inner ends are pivotally connected to the load receiving block 2, and a pair of front and rear pivot shafts *7a* and *7b*. The front pivot shaft *7a* pivotally connects outer ends of the front lower and upper arms *5a* and *6a*, and the rear pivot shaft *7b* pivotally connects outer ends of the rear lower and upper arms *5b* and *6b*.

The threaded rod 4 is disposed such as to laterally pass through both the pivot shafts *7a* and *7b*. A tip end portion of the threaded rod 4 is threadedly inserted through the front pivot shaft *7a*, and a base end of the threaded rod 14 is rotatably but axially relatively non-movably supported by the rear pivot shaft *7b*. A U-shaped driven joint 8 is secured to a base end of the threaded rod 4.

If the threaded rod 4 is rotated through the driven joint 8 such as to protrude from the front pivot shaft *7a*, both the pivot shafts *7a* and *7b* approach to each other so that each of the arms *5a*, *5b*; *6a*, *6b* stands to lift the load receiving block 2. If the threaded rod 4 is rotated in the opposite direction, both the pivot shafts *7a* and *7b* are moved away from each other so that each of the arms are tilted down to lower the load receiving block 2.

Next, the electric power tool T for driving the jack J will be described with reference to FIGS. 1 to 11. Referring first to FIGS. 1 to 4, the electric power tool T includes an electric driving unit 12 having a normally and reversely rotatable DC motor 10 and a speed reducer 11 connected to a front portion of the DC motor 10. The motor 10 includes an electric code 13. The electric code 13 is provided at its end with a plug 14 which can be connected to a power source socket of the automobile. The electric code 13 is also provided at its intermediate portion with a normally-opened type control switch 15 for normally and reversely rotating the motor 10. An output shaft 16 is projected from a front surface of the speed reducer 11 for speed-reducing the rotation of a rotor shaft of the motor 10 to output the same, and a driving joint 17 is mounted to a tip end of the output shaft 16.

The driving joint 17 includes a joint block 17*a* which is secured to the output shaft 16 by a setscrew 18, and a U-shaped joint plate 17*b* which is welded at its opposite ends to the joint block 17*a* and is projected toward a front surface of the joint block 17*a*. The joint plate 17*b* is formed at its front wall with an elongated connection hole 19.

A handle 20 projected toward the motor 10 is secured to an upper surface of the speed reducer 11, and a bracket 21 projected toward the output shaft 16 is secured to a lower surface of the speed reducer 11. A slide plate 22 is mounted to the bracket 21 at a forward position of the driving joint 17 such that the slide plate 22 can slide in a lateral direction perpendicular to an axis of the output shaft 16. More specifically, the slide plate 22 is formed with a slotted hole 23 extended in its sliding direction, and a guide shaft 24 which is relatively slidably fitted through the slotted hole 23 is secured to the bracket 21.

The slide plate 22 has a U-shaped cross section and includes a pair of left and right side walls 22*a* and 22*b* arranged in a sliding direction of the slide plate 22 so as to oppose to each other. A cup-like shallow first pivot holder 25 is secured to the left side wall 22*a* and is capable of engaging a left outer end of the rear pivot shaft 7*b*. The right side wall 22*b* is formed with a boss 28 for slidably supporting a butterfly-shaped clamping bolt 27. A cup-like shallow second pivot holder 26 which can engage a right outer end of the rear pivot shaft 7*b* is rotatably connected to a tip end of the clamping bolt 27. A nut 29 is threadedly engaged through the clamping bolt 27 between the right side wall 22*b* and the second pivot holder 26. A nut-keeping plate 30 is turnably mounted at its one end to the right wall 22*b* through a bolt 31 for engaging an outer peripheral surface of the nut 29 to prevent the nut 29 from rotating.

The nut-keeping plate 30 includes a bulged portion 30*a* which is bulged so as to separate from an inner surface of the right side wall 22*b*. The bulged portion 30*a* is formed with a U-shaped notch 32 for receiving a screw portion of the clamping bolt 27. A pressure pin 33 is secured to the bulged portion 30*a* for abutting against and holding an outer peripheral surface of the nut 29 to prevent the nut 29 from rotating when the notch 32 receives the screw portion of the clamping bolt 27. Depending upon a location of the nut 29, the notch 32 engages the outer peripheral surface of the nut 29 for preventing the nut 29 from rotating.

A knob 30b is formed at a tip end of the nut-keeping plate 30. A transparent protective cover 34 made of synthetic resin is mounted to the speed reducer 11 for covering an outer periphery of the driving joint 17.

The slide plate 22, the first and second pivot holders 25 and 26, the clamping bolt 27, the nut 29 and the nut-keeping plate 30 compose a pivot holding means H which can hold the rear pivot shaft 7*b* of the jack J irrespective of the length of the pivot shaft 7*b*.

Next, the operation of the embodiment will be described below.

Figure 5:
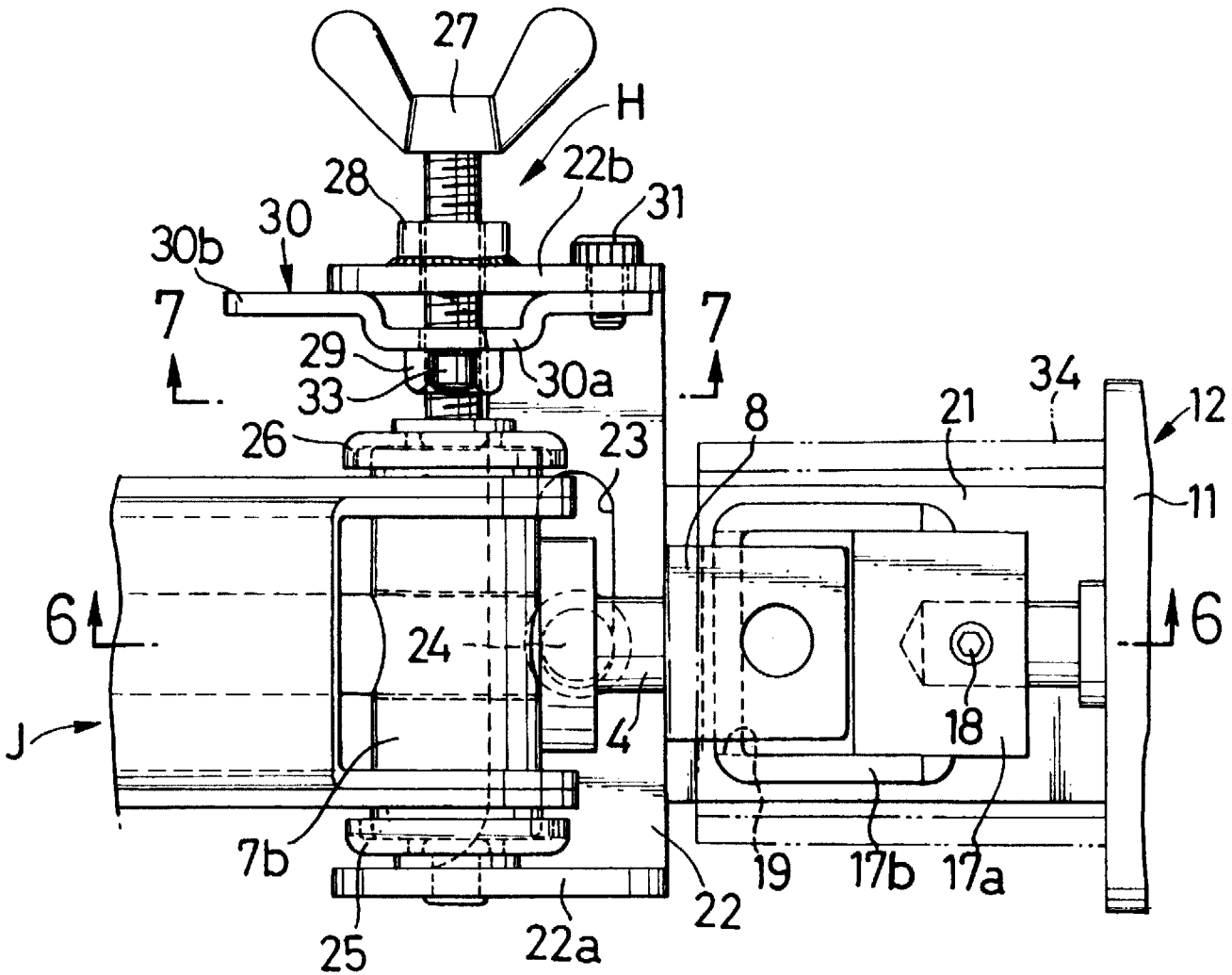
FIG. 5 is a plan view of an essential portion of the electric power tool connected to a small jack.
Figure 6:
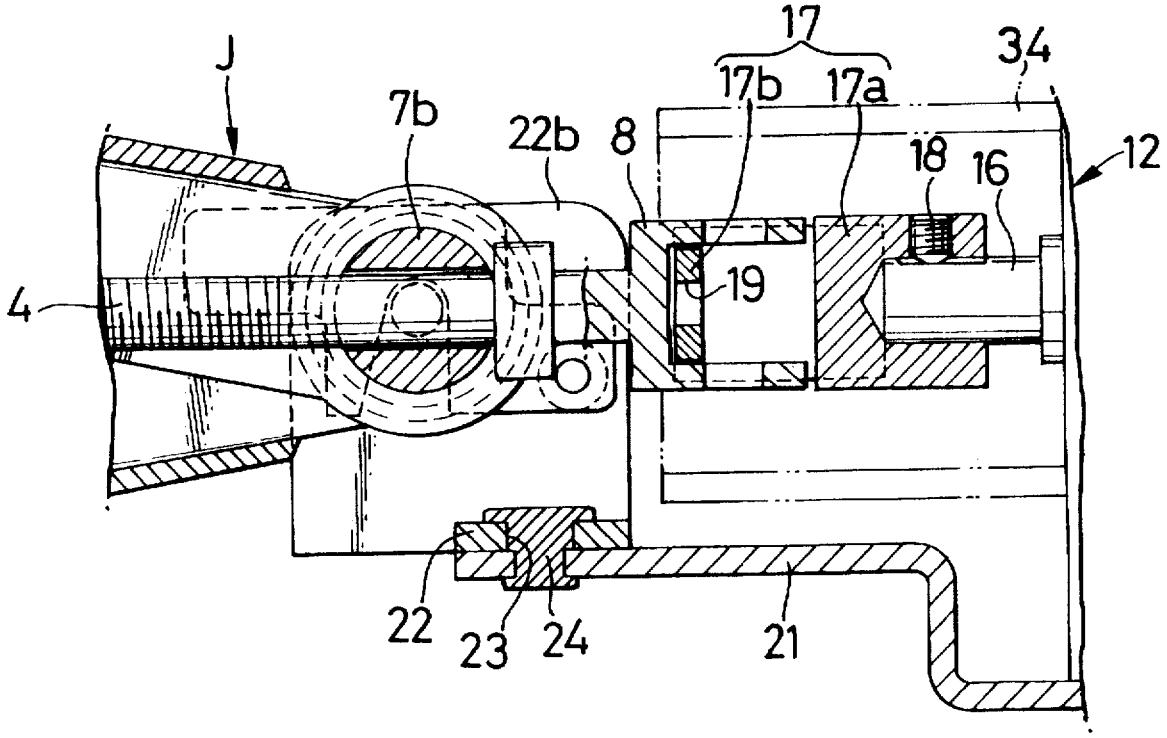
FIG. 6 a sectional view taken along a line 6—6 in FIG. 5.
Figure 7:
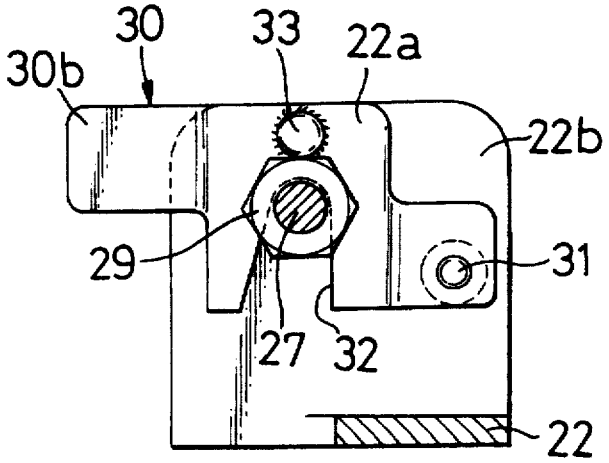
FIG. 7 a sectional view taken along a line 7—7 in FIG. 6.

When the electric power tool T is used for driving the jack J, the driving joint 17 of the electric power tool T is first engaged within the U-shaped driven joint 8 of the jack J as shown in FIGS. 5 and 6. Then, opposite ends of the rear pivot shaft 7*b* of the jack J are held by the first and second pivot holders 25 and 26 in a manner described below.

Figure 8:
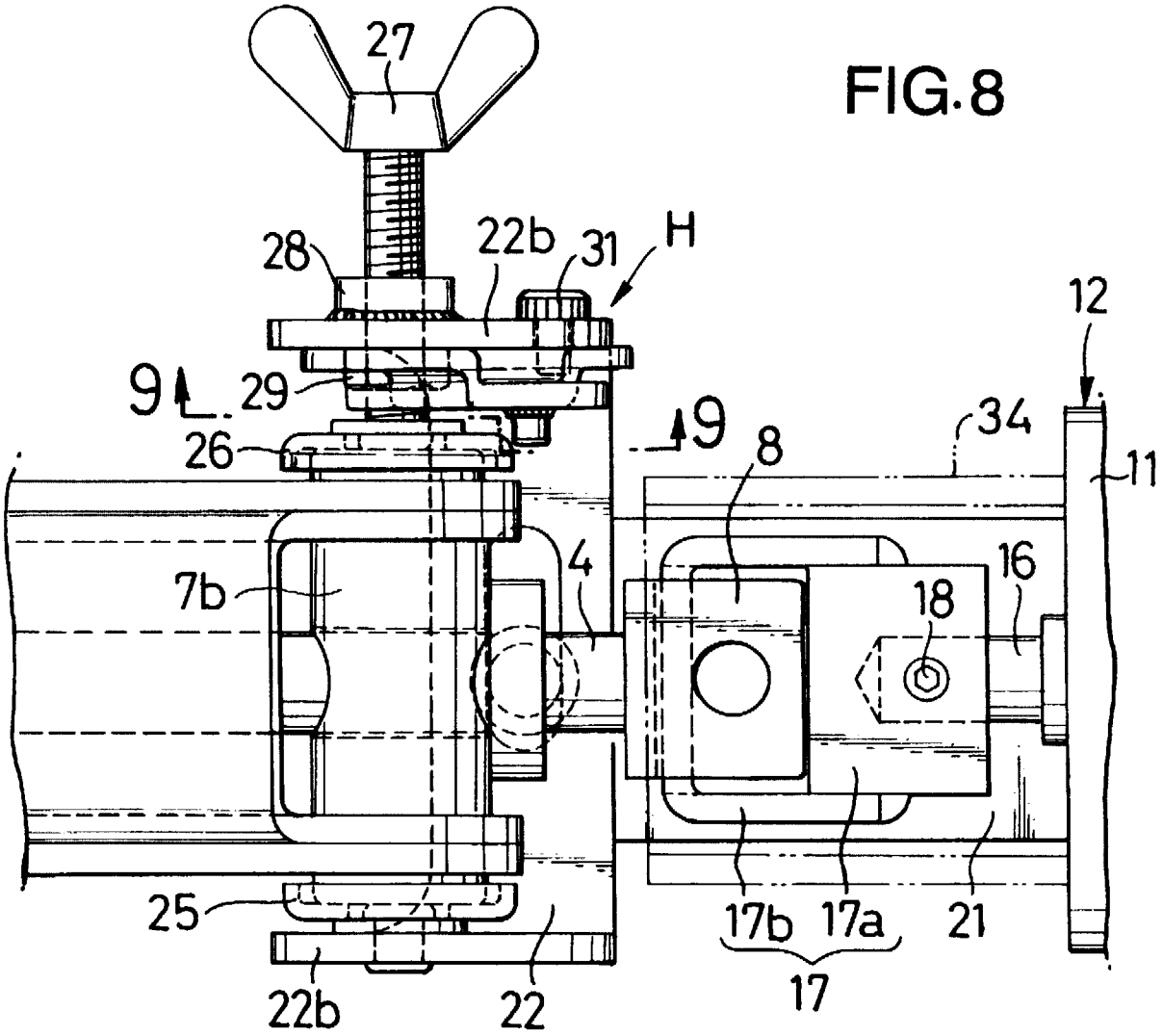
FIG. 8 is similar to FIG. 5 but illustrating a plan view of an essential portion of the electric power tool connected to a big jack.
Figure 9:
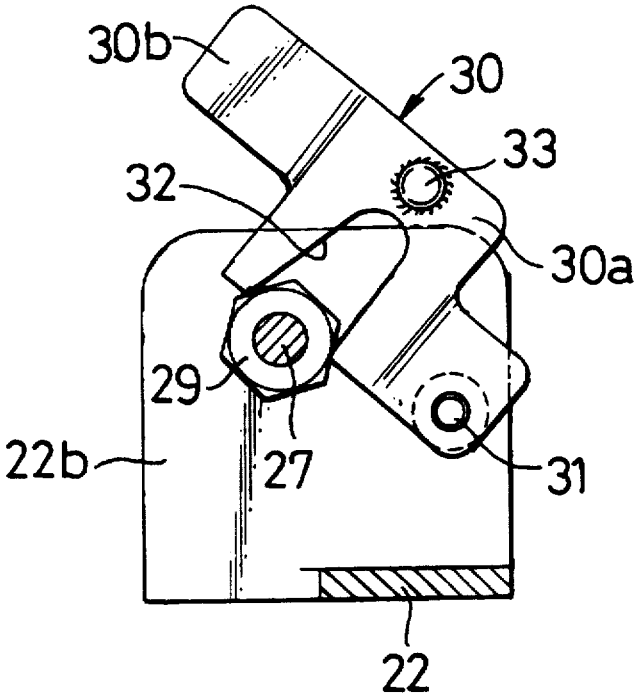
FIG. 9 a sectional view taken along a line 9—9 in FIG. 8.

As shown in FIGS. 5 and 8, a length of each of the pivot shafts 7*a* and 7*b* of the jack J varies depending upon a size of the jack J. When the pivot shaft 7*b* is relatively short as shown FIG. 5, the clamping bolt 27 is first pushed inwardly of the right side wall 22*b* of the slide plate 22 and then, the nut-keeping plate 30 is turned down such that the notch 32 receives the screw portion of the clamping bolt 27, and the outer peripheral surface of the nut 29 is held by the pressure pin 33 for fixing the nut 29 (see FIGS. 5 to 7). If the clamping bolt 27 is rotated in its clamping direction, the opposite ends of the rear pivot shaft 7*b* which is relatively short can be clamped and held by the first and second pivot holders 25 and 26.

When the pivot shafts 7*a* and 7*b* are relatively long as shown in FIG. 8, the nut-keeping plate 30 is first turned up to a position where the plate 30 is not interfered with the nut 29 and then, the clamping bolt 27 is pulled outward of the right side wall 22*b* to bring the nut 29 into abutment against an inner surface of the right side wall 22*b*. Next, the nut-keeping plate 30 is turned down such that the notch 32 engages an outer peripheral surface of the nut 29 to prevent the nut 29 from rotating. Then, if the clamping bolt 27 is rotated in its clamping direction, opposite ends of the rear pivot shaft 7*b* which is relatively long can be held by both the pivot holders 25 and 26.

A distance between both the pivot holders 25 and 26 can largely and easily be varied by turning the nut-keeping plate 30 and by axially moving the clamping bolt 27 in this manner. Therefore, it is possible to hold the rear pivot shaft 7*b* irrespective of its length, by rotating the clamping bolt 27 through relatively small number of rotations.

During that time, the bracket 21 is slid in either of left and right direction with respect to the slide plate 22 so as to bring axes of both the joints 8 and 17 into agreement with each other.

Thereupon, the plug 14 of the electric code 13 is connected to the electric socket of the automobile and the control switch 15 is operated for normal or reverse rotation. By this, the motor 10 is rotated in a normal or reverse direction and such rotation is reduced in speed by the speed reducer 11 to drive the threaded rod 4 in a normal or reverse direction through the output shaft 16 and both the joints 17 and 8. Therefore, the load receiving block 4 can be lifted or lowered. At that time, a reaction force torque of the output shaft 16 is supported by the jack J through the bracket 21 and the pivot holding means H.

Figure 10:
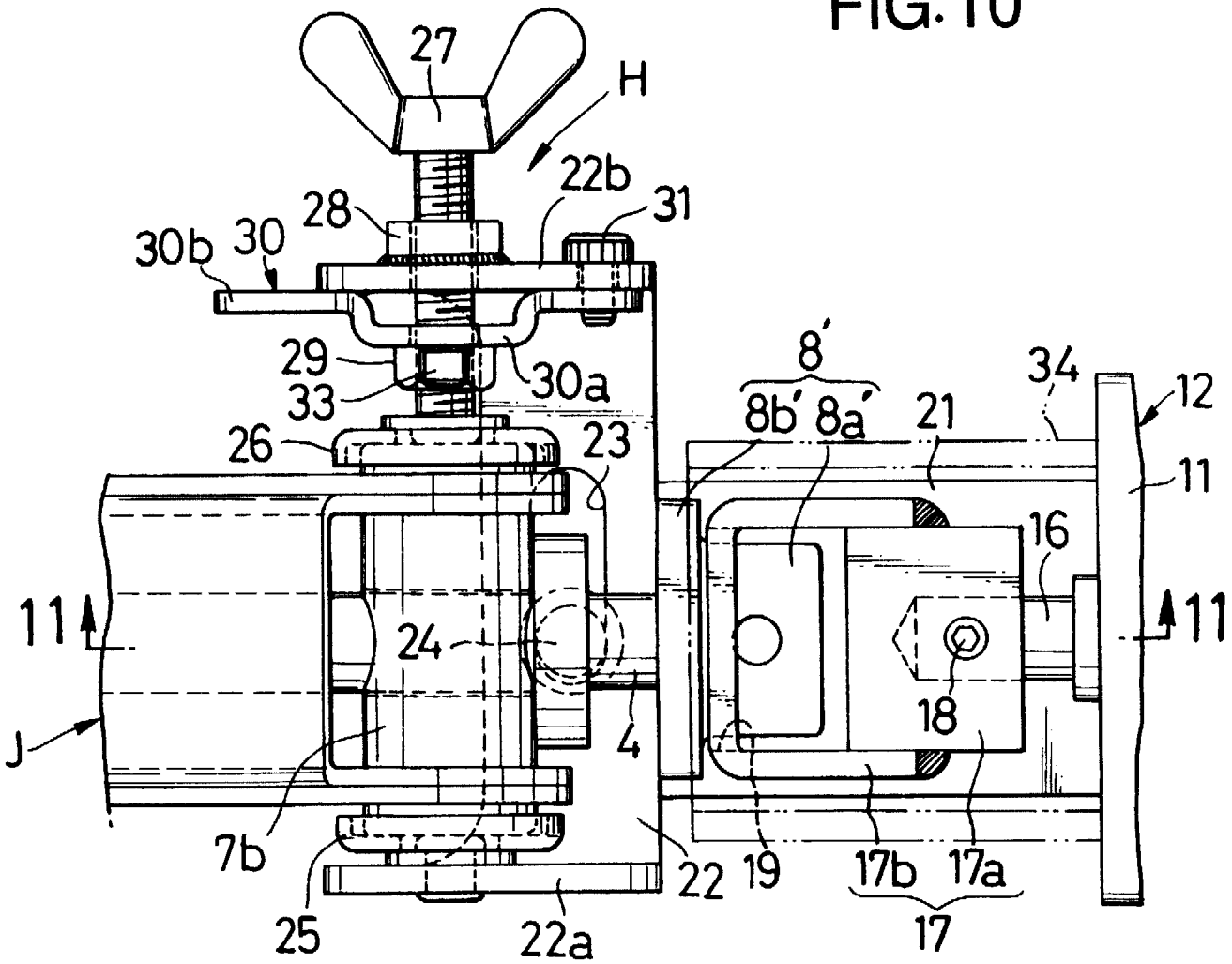
FIG. 10 is similar to FIG. 5 but illustrating a plan view of an essential portion of the electric power tool connected to a T-shaped jack.
Figure 11:
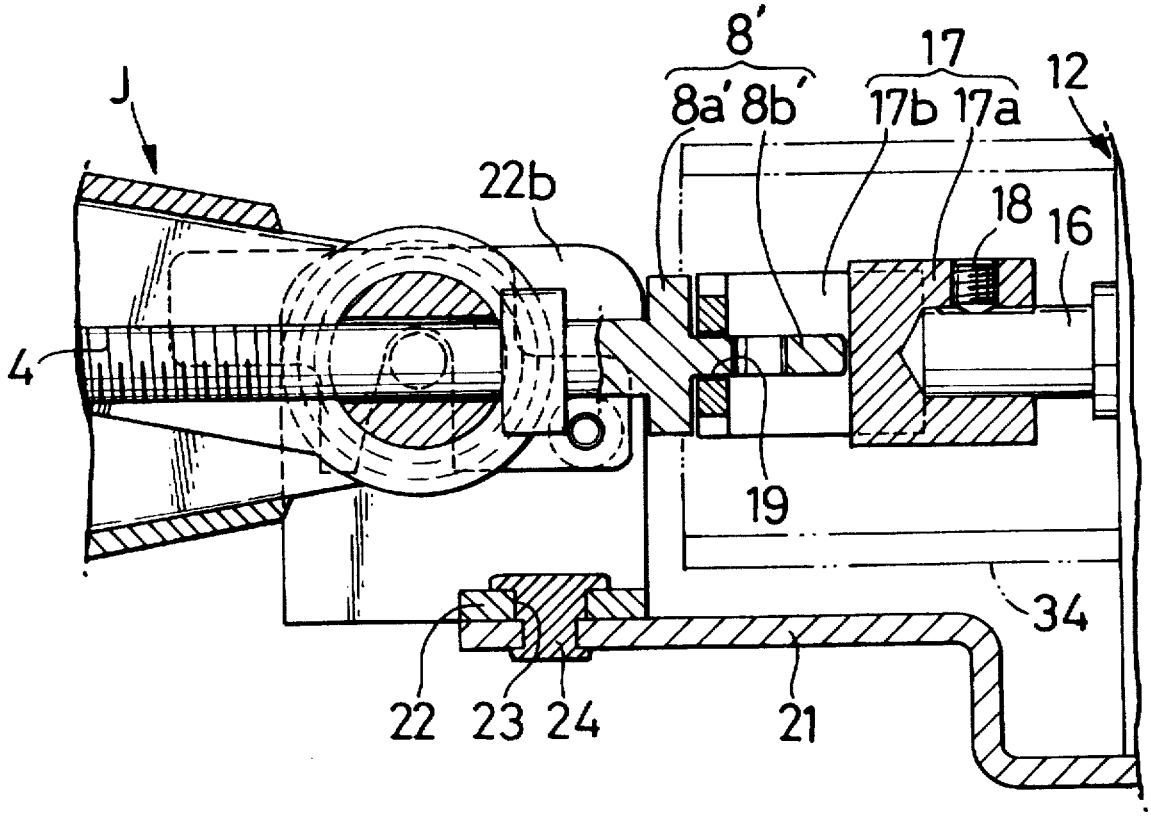
FIG. 11 a sectional view taken along a line 11—11 in FIG. 10.

FIGS. 10 and 11 illustrate an electric power tool T in which a T-shaped joint having a connection plate 8*b'* projectingly provided on a flange 8*a'* on a base end of the threaded rod 4 is employed as a driven joint 8*a'* of the jack J. In order to operate such jack J, the connection plate 8*b'* of the driven joint 8' is inserted into the elongated connection hole 19 of the driving joint 17 so as to bring the flange 8*a'* into abutment against a front surface of the driving joint 17. The rear pivot shaft 7*b* is held by both the pivot holders 25 and 25 in the same manner as described above.

Therefore, if the motor 10 is operated, a rotation of the output shaft 16 can be transmitted from the driving joint 17 through the connection plate 8*b'* of the driven joint 8' to the threaded rod 4.

Although the embodiment of the present invention have been described in detail, it will be understood that the present invention is not limited to the above-described embodiment, and various modifications in design may be made without departing from the spirit and scope of the invention defined in claims. For example, the clamping bolt 27 can directly be threadedly engaged with the boss 28 of the bracket 21 without using the nut 29 and the nut-keeping plate 30.

Although the embodiment of the present invention has been described in detail, it will be understood that the present invention is not limited to the above-described embodiment, and various modifications in design may be made without departing from the spirit and scope of the invention defined in claims. For example, the clamping bolt 27 can directly be threadedly engaged with the boss 28 of the bracket 21 without using the nut 29 and the nut-keeping plate 30.

What is claimed is:

1. An electric power tool for driving a jack, comprising:

an electric driving unit including a reversible motor, a driving joint provided on an output shaft of said electric driving unit, said driving joint being capable of being connected and engaged with a driven joint of a jack, said jack having a front and a rear pivot shaft, wherein said driving joint comprises a joint block secured to said output shaft and a joint plate which is coupled at opposite ends thereof to said joint block, said joint plate being projected forwardly of said joint block formed at its projected portion with an elongated connection hole, said joint plate and said elongated connection hole being formed such that when said driven joint of said jack is U-shaped, said joint plate can be connected and engaged within said U-shaped driven joint, whereas when said driven joint of said jack is T-shaped, said elongated connection hole can be connected and engaged with a connection plate of said T-shaped driven joint, and wherein said rear pivot shaft of said jack is clamped between a pivot holding means which can hold said rear pivot shaft irrespective of the length of said rear pivot shaft.

2. An electric power tool for driving a jack as in claim 1, wherein said pivot holding means comprises:

a slide plate having a left side wall, right side wall and slotted bottom portion whereby said slide plate is slidably connected to a bracket, said bracket being connected to said electric driving unit;

a first pivot holder secured to said left side wall which can engage a left outer end of said rear pivot shaft, said right side wall being formed with a boss for turnably supporting a butterfly-shaped clamping bolt;

a second pivot holder, rotatably connected to a tip end of said clamping bolt, wherein said second pivot holder can engage a right outer end of said rear pivot shaft, whereby said clamping bolt can be turned such that said second pivot holder travels toward said first pivot holder until said rear pivot shaft is securely clamped between said holders.

* * * * *